US006173063B1

(12) United States Patent
Melanson

(10) Patent No.: US 6,173,063 B1
(45) Date of Patent: Jan. 9, 2001

(54) OUTPUT REGULATOR FOR FEEDBACK REDUCTION IN HEARING AIDS

(75) Inventor: John Laurence Melanson, Boulder, CO (US)

(73) Assignee: GN ReSound as (DK)

( * ) Notice: Under 35 U.S.C. 154(b), the term of this patent shall be extended for 0 days.

(21) Appl. No.: 09/241,516

(22) Filed: Oct. 6, 1998

(51) Int. Cl.[7] ..... H04R 25/00

(52) U.S. Cl. ..... 381/318; 381/312; 381/321; 330/251; 330/10

(58) Field of Search ..... 381/312, 313, 381/316, 317, 318, 320, 321, 83, 93, FOR 127, FOR 128, FOR 129, FOR 131, 71.6, 71.1, 71.8, 71.11, 71.12, 71.13, 71.14, 94.1, 94.2, 94.7; 330/10, 251, 207 A; 323/241, 322, 283

(56) References Cited

U.S. PATENT DOCUMENTS 4,543,453 * 9/1985 Brander ..... 381/321
4,689,819 * 8/1987 Killion ..... 381/321
4,783,818 * 11/1988 Graupe et al. ..... 381/93
4,941,179 * 7/1990 Bergenstoff et al. ..... 381/321
5,016,280 * 5/1991 Engebretson et al. ..... 381/93
5,091,952 * 2/1992 Williamson et al. ..... 381/318
5,247,581 * 9/1993 Gurcan ..... 381/321
5,259,033 * 11/1993 Goodings et al. ..... 381/318
5,506,532 * 4/1996 Milazzo ..... 381/312
5,559,467 9/1996 Smedley ..... 330/10
5,680,467 * 10/1997 Hansen ..... 381/93
5,838,807 * 11/1998 Andersson et al. ..... 381/321

FOREIGN PATENT DOCUMENTS

051261 * 2/1994 (EP) ..... 381/FOR 127

* cited by examiner

*Primary Examiner*—Forester W. Isen
*Assistant Examiner*—Xu Mei
(74) *Attorney, Agent, or Firm*—Jennifer L. Bales; Macheledt Bales & Johnson LLP

(57) ABSTRACT

In a hearing aid having feedback cancellation, a voltage regulator is provided to regulate the voltage from the hearing aid battery to the class D output. Feedback cancellation processing dynamically models the entire acoustic feedback path from the hearing aid processing to microphone, including the gain of the output stage. The gain of the output stage varies with the voltage of the battery, and the battery voltage depresses when a loud signal is processed by hearing aid, so the voltage regulator prevents the output stage gain from varying with time.

3 Claims, 1 Drawing Sheet

OUTPUT REGULATOR FOR FEEDBACK REDUCTION IN HEARING AIDS

Pending patent application Ser. No. 08/972,265, filed Nov. 18, 1997 and entitled "Feedback Cancellation Apparatus and Methods," and pending patent application Ser. No. 09/081,474, filed May 19, 1998 and entitled "Feedback Cancellation Improvements" are incorporated herein by reference.

BACKGROUND OF THE INVENTION

1. Field of the Invention

The present invention relates to apparatus and methods for regulating feedback related to hearing aid output stages. More particularly, this invention relates to regulating feedback related to hearing aid output stages in hearing aids having feedback cancellation processing.

2. Description of the Prior Art

In order to save complexity and power in a digital signal processing hearing aid, it is valuable to use a direct digital to class D output stage. Power dissipation is low, and no analog circuitry is required. A problem arises with this configuration, due to the fact that the gain of the output stage varies with the voltage of the battery used to power it. The battery voltage depresses when a loud signal is processed by the hearing aid, for example.

In hearing aids incorporating feedback cancellation, the feedback cancellation algorithm attempts to model the acoustic feedback path, including the effects of the hearing aid amplifier, receiver, and microphone as well as the vent acoustics. Thus, the feedback cancellation algorithm attempts to match the gain of the output amplifier, which varies with the voltage of the battery.

A need remains in the art for apparatus and methods for regulating the voltage to the output stage of the amplifier, in order to regulate feedback effects of variation in gain caused by voltage variations.

SUMMARY OF THE INVENTION

It is an object of the present invention to provide apparatus and methods for regulating the voltage to the output stage of the amplifier, in order to regulate feedback effects of variation in gain caused by voltage variations.

DETAILED DESCRIPTION OF THE PREFERRED EMBODIMENT

Figure 1:
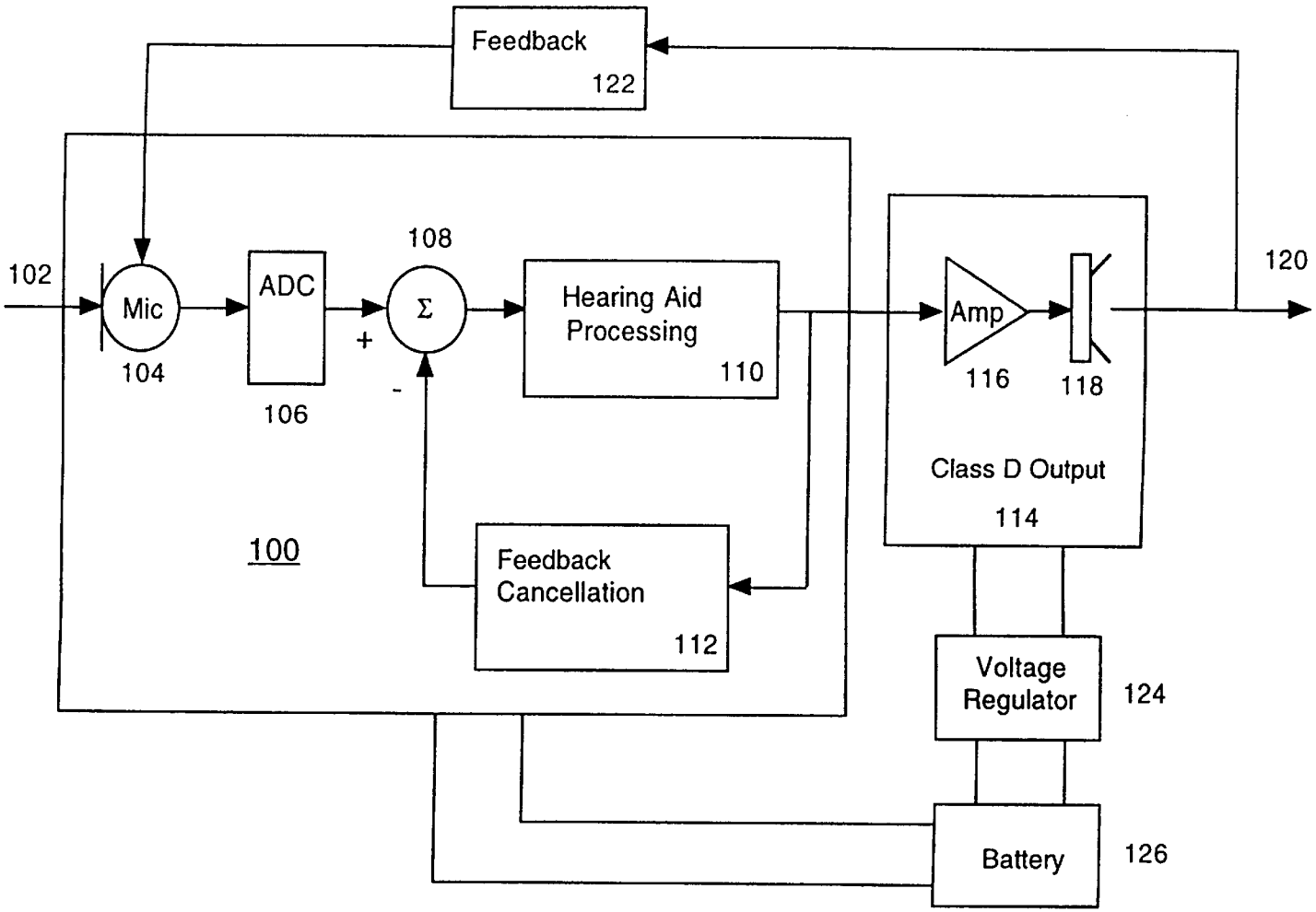
FIG. 1 shows a hearing aid having feedback cancellation and utilizing a voltage regulator to regulate the voltage to the class D output, according to the present invention.

FIG. 1 shows a hearing aid 100 having feedback cancellation 112 and utilizing a voltage regulator 124 to regulate the voltage from battery 126 to class D output 114. Audio input signal 102 is inevitably combined with feedback signal 122, representing the feedback from receiver 118. To account for this unwanted feedback signal, feedback cancellation processing 112 dynamically models the entire acoustic feedback path from hearing aid processing 110 to microphone 104, including the effects of the hearing aid amplifier 116, receiver 118, and microphone 104 as well as the vent acoustics (not shown).

Voltage regulator 124 is useful in this device, because the gain of output stage 114 varies with the voltage of battery 126. The battery voltage depresses when a loud signal is processed by hearing aid 100, for example. Since feedback cancellation processing 112 is trying to model the feedback path, including the gain, it is undesirable to have the gain vary with time.

In the preferred embodiment, voltage regulator 124 is only used to regulate the voltage to output stage 114. However, it is also possible to regulate the voltage from battery 126 to the other elements of hearing aid 100.

While the exemplary preferred embodiments of the present invention are described herein with particularity, those skilled in the art will appreciate various changes, additions, and applications other than those specifically mentioned, which are within the spirit of this invention.

What is claimed is:

1. A hearing aid comprising:

a microphone for converting sound into an audio signal;

an analog to digital converter (ADC) for converting the audio signal into a digital input signal;

feedback cancellation means including means for estimating a physical feedback signal of the hearing aid, and means for modelling a signal processing feedback signal to compensate for the estimated physical feedback signal;

subtraction means, connected to the output of the ADC and the output of the feedback cancellation means, for subtracting the signal processing feedback signal from the digital input signal to form a compensated digital audio signal;

hearing aid processing means, connected to the output of the subtraction means, for processing the compensated digital audio signal;

wherein said feedback cancellation means forms a feedback path from the output of the hearing aid processing means to the input of the subtracting means;

digital class D output means, connected to the output of the hearing aid processing means, for converting the processed compensated digital audio signal into a sound signal;

a power source for powering the digital class D output means; and a voltage regulator connected between the power source and the digital class D output means for regulating the power to the digital class D output means.

2. The apparatus of claim 1, wherein the battery also powers other elements of the hearing aid, and wherein the voltage regulator regulates the power to the other elements.

3. The apparatus of claim 1, wherein the battery also powers other elements of the hearing aid, and wherein the voltage regulator does not regulate the power to the other elements.

* * * * *